US005490762A

United States Patent [19]

Feucht et al.

[11] Patent Number: 5,490,762

[45] Date of Patent: Feb. 13, 1996

[54] WEEP HOLE PLUG FOR A FLUID CIRCULATING PUMP

[75] Inventors: Joel D. Feucht, Morton; Stephen G. Shoup; Victor E. Swanson, both of Peoria, all of Ill.

[73] Assignee: Caterpillar Inc., Peoria, Ill.

[21] Appl. No.: 407,819

[22] Filed: Mar. 21, 1995

[51] Int. Cl.[6] ..... F04D 29/08

[52] U.S. Cl. ..... 415/168.1

[58] Field of Search ..... 415/168.1

[56] References Cited

U.S. PATENT DOCUMENTS

| | | | |
|---|---|---|---|
| 4,621,975 | 11/1986 | Larson | 415/168.1 |
| 4,973,222 | 11/1990 | Osaki et al. | 415/168.1 |
| 5,154,576 | 10/1992 | Dorski et al. | 415/168.2 |
| 5,226,786 | 7/1993 | Dorski et al. | 415/168.2 |
| 5,338,153 | 8/1994 | Swanson et al. | 415/168.2 |

FOREIGN PATENT DOCUMENTS

| | | |
|---|---|---|
| 231279 | 1/1964 | Austria . |
| 481968 | 8/1929 | Germany . |
| 512339 | 9/1939 | United Kingdom . |
| 84/04365 | 11/1984 | WIPO . |

*Primary Examiner*—John T. Kwon
*Attorney, Agent, or Firm*—Diana L. Charlton

[57] ABSTRACT

The present invention provides a fluid circulating pump utilizing a plug assembly sealingly disposed within a weep hole located in a secondary compartment of a cavity. The plug assembly is disposed within the weep hole and has a tube portion extending a predetermined length into the secondary compartment. A connector holds the plug assembly within the second compartment and sealingly engages the plug assembly with the weep hole. The length of the tube portion is sufficient to contain the leaked fluid within the secondary compartment until it can be evaporated, substantially eliminating fluid leakage into the atmosphere. However, excessive fluid build-up may occur within the secondary compartment when the pump is damaged. The present invention allows the excessive fluid to leak out to the atmosphere through a bore in the plug assembly to signal that pump repair is needed.

5 Claims, 2 Drawing Sheets

WEEP HOLE PLUG FOR A FLUID CIRCULATING PUMP

TECHNICAL FIELD

This invention relates generally to a fluid circulating pump for use in an internal combustion engine and more particularly to the substantial elimination of dripping leaked fluid into the environment.

BACKGROUND ART

Present day engines are being manufactured to meet or exceed stringent environmental standards in order to preserve the world in which we live. Engine improvements are constantly being made in an effort to accomplish this goal. It is for this reason that engine components, such as pumps, are being manufactured to minimize or eliminate fluid leakage into the environment.

The cooling fluid circulating pump for most internal combustion engines has a shaft rotatably mounted within a pump housing. A coolant seal assembly surrounds the shaft to substantially isolate a first housing chamber containing coolant from an intermediate housing chamber. A second housing chamber contains an oil lubricated bearing assembly and is isolated from the intermediate housing chamber by a secondary seal assembly. An impeller is attached to the end of the shaft and is located within the first housing chamber. During operation, as the impeller rotates to circulate cooling fluid within the engine, coolant invariably leaks around the coolant seal assembly and into the intermediate housing chamber due to the nature of the seal. A weep hole,which is open to the atmosphere, is provided in the intermediate housing chamber so that the leaked coolant may escape from the pump housing without contaminating the oil or damaging the bearing assembly within the second housing chamber. Unfortunately, coolant in varying amounts is leaked into the atmosphere causing environmental concern and lower customer perception of the product.

The present invention provides an inexpensive design to minimize or substantially eliminate leaked fluid from dripping from a pump. The present invention is therefore directed to overcome one or more of the problems as set forth above.

DISCLOSURE OF THE INVENTION

In one aspect of the present invention a fluid circulating pump is adapted for use in an internal combustion engine. A housing has a fluid chamber and a cavity. A shaft is rotatably mounted within the housing and extends through the cavity and terminates in the fluid chamber. A seal assembly is in surrounding relation to the shaft to substantially isolate the fluid chamber from the cavity. The cavity has an open end which communicates with the atmosphere. A plug has a bore therethrough and is slidably disposed within and in contacting relationship with the housing at the open end. The plug has a cylindrical head portion and an elongated portion which extends from the head portion and terminates a predetermined length into the cavity. Connecting means is attached to the plug for holding the plug in the housing and for sealingly engaging the plug with the open end so that fluid is restricted from escaping into the atmosphere.

The disadvantage of the prior art is that they fail to provide a means for minimizing or eliminating small amounts of leaked fluid from dripping from the pump to the atmosphere. The present invention, through the use of a plug means within an open end of a cavity substantially eliminates leaked fluid from dripping from the pump.

BEST MODE FOR CARRYING OUT THE INVENTION

Figure 1:
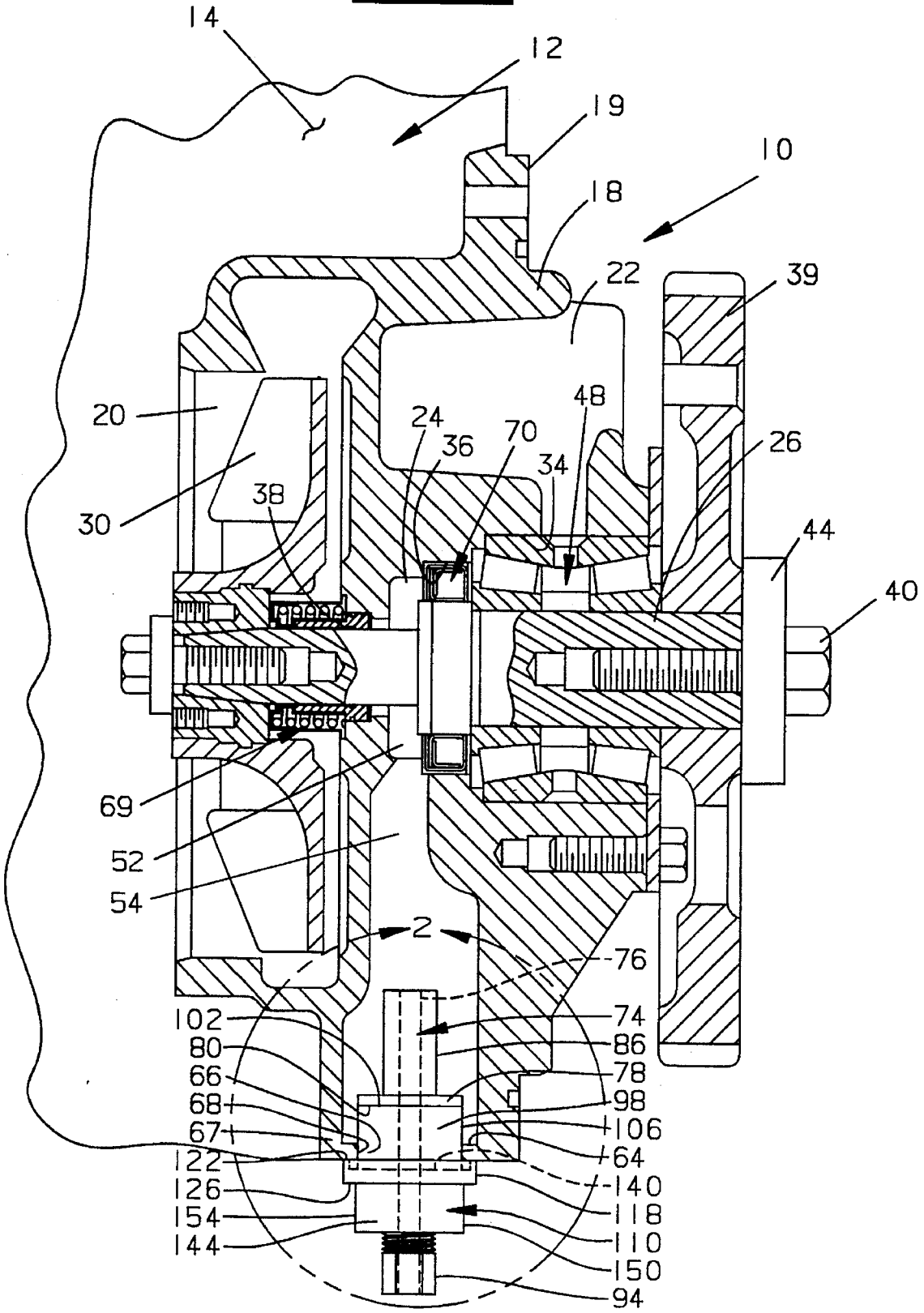
FIG. 1 is a diagrammatic section view of an embodiment of the present invention.
Figure 2:
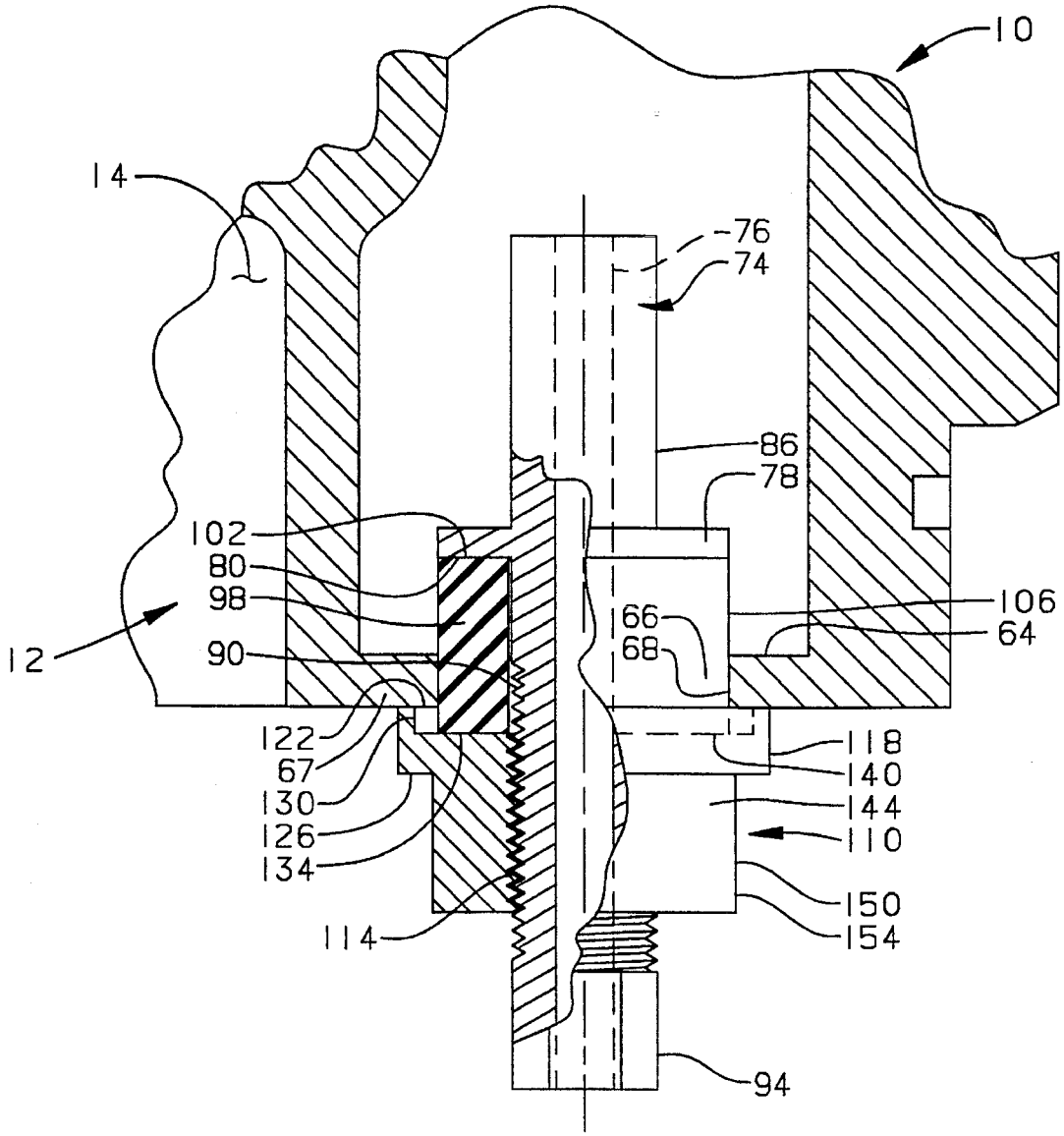
FIG. 2 is a detail view of the area of FIG. 1 encircled by line 2.

A cooling fluid circulating pump 10 for an internal combustion engine 12 having a conventional cylinder block 14 is shown in FIGS. 1 and 2. The circulating pump 10 is conventionally mounted to the cylinder block 14 in any suitable manner. The circulating pump 10 pumps coolant through a cooling system (not shown) having a radiator (not shown) and includes a housing 18 having an outer wall 19. The housing 18 defines a first fluid chamber 20, a second fluid chamber 22, and an intermediate cavity 24. A shaft 26 is rotatably mounted within the housing 18 and extends through the cavity 24 and into the first fluid chamber 20. An impeller 30 is located within the first fluid chamber 20 and is mounted to the shaft 26 for rotation therewith. The housing 18 defines first 34, second 36, and third 38 axially aligned bores. A gear 39 is conventionally driven, such as by a crankshaft (not shown), and fastened by a bolt 40 and washer 44 to the shaft 26. A bearing assembly 48 is disposed within the first bore 34 of the housing 18 for rotatably supporting the shaft 26.

The first fluid chamber 20 contains and circulates cooling system coolant by means of the impeller 30 located within the chamber 20. The cavity 24 defines a primary compartment 52 in surrounding relation to the shaft 26 and a secondary compartment 54. The secondary compartment 54 extends outwardly from the primary compartment 52 and terminates at an annular shoulder 64. The outer wall 19 of the housing 18 defines an open end 66, such as a weep hole, therethrough extending into the secondary compartment 54 and communicating with the atmosphere. The diameter of the weep hole 66 is smaller than the diameter of the secondary compartment 54 defining a flange 67 on the outer wall 19 of the housing 18. The flange 67 extends inwardly toward and terminates within the secondary compartment 54 to define an annular wall 68.

A coolant seal assembly 69 of any suitable type is disposed within the third bore 38 in sealing engagement with the shaft 26 to substantially sealingly isolate the first fluid chamber 20 from the primary compartment 52. An oil seal assembly 70 of any suitable type is disposed within the second bore 36 in sealing engagement with the shaft 26 to substantially sealingly isolate the primary compartment 52 from the bearing assembly 48.

A plug assembly 74 is sealingly disposed within the weep hole 66 for restricting coolant from escaping into the atmosphere. The plug assembly 74 has a bore 76 therethrough and includes a cylindrical head portion 78 with a lower surface 80. An elongated tube portion 86 extends from the cylindrical head portion 78 and terminates a predetermined distance into the secondary compartment 54. An elongated, threaded portion 90 extends from the cylindrical head portion 78 in a direction opposite the elongated tube portion 86 and terminates a predetermined distance into the atmosphere. A hexoganally shaped portion 94 extends from the threaded portion 90. A non-metallic grommet 98 with a predetermined diameter substantially equal to the diameter of the weep hole 66 is made from any suitable material, such as rubber, and surrounds a portion of the threaded portion 90. The grommet 98 has a top surface 102 seated against the lower surface 80 of the cylindrical head portion 78. The grommet 98 is seated within the weep hole 66 with an outer surface 106 contacting the flange 67.

A connecting means 110 with an internally threaded bore 114 is threaded onto the threaded portion 90. The connecting means 110 includes a cylindrical crown portion 118 with a top surface 122, bottom surface 126, and an inner wall 130 with a predetermined diameter larger than the predetermined diameter of the grommet 98 and the weep hole 66. The inner wall 130 extends downwardly from the top surface 122 toward the bottom surface 126 and terminates at a shoulder 134. The connecting means 110 is positioned so that the grommet 98 is disposed between the cylindrical head portion 78 and the connecting means 110 with a lower surface 140 of the grommet 98 seated against the shoulder 134. A lower portion 144 of the connecting means 110 extends downwardly from the bottom surface 126 and has a first planar surface 150 and a second planar surface 154 parallel with the first planar surface 150.

INDUSTRIAL APPLICABILITY

In use, the plug assembly 74 is positioned within the weep hole 66 so that the outer surface of the grommet 98 contacts the annular wall 68 of the flange 67. The connecting means 110 is threaded onto the elongated threaded portion 90 until the top surface of the connecting means 110 contacts the outer wall 19 of the housing 18 at the flange 67 and the grommet 98 is virtually seated against the shoulder 134. The connecting means 110 is then tightened against the outer wall 19 of the housing 18 causing the grommet 98 to expand radially inwardly against the threaded portion 90 and radially outwardly against the annular wall 68 substantially sealing the secondary compartment 54 from the atmosphere.

Coolant is circulated by the impeller throughout the cooling system of the internal combustion engine 12 to cool the engine 12. Due to the nature of the coolant seal assembly 68, coolant within the fluid chamber 20 may leak around the coolant seal assembly 68 and into the cavity 24.

Leaked coolant now within the cavity 24 flows toward the outer wall 19 of the housing 18 and around the plug assembly 74 within the secondary compartment 54. The coolant is restricted from leaking into the atmosphere due to the sealing achieved with the grommet 98. Coolant will generally accumulate to a depth less than the height of the elongated tube portion 86 where it will be slowly evaporated by air circulating within the secondary compartment 54.

Major coolant pump leakage, such as that brought about by coolant seal assembly failure, must be visible so that the pump may be repaired. In this event, the depth of the coolant will exceed the height of the elongated tube portion 86. Therefore, the bore 76 in the plug assembly 74 and connecting means 110 will allow the excessive coolant from a major leak to escape out into the atmosphere. This is necessary not only to alert the customer of necessary repair work, but additionally, restricts coolant from entering the oil seal assembly 70 and damaging the bearing assembly 48 in the pump 10.

In view of the above, it is apparent that the present invention provides an improved means to substantially eliminate the dripping of leaked coolant from a fluid circulating pump into the atmosphere. The present invention utilizes a plug assembly disposed within a weep hole of a secondary compartment of the fluid circulating pump. The plug assembly is connected to the pump housing in a manner which creates a seal between a grommet in the plug assembly and the open end leading to the atmosphere. Leaked coolant accumulates around the plug assembly. However, the leaked coolant depth is controlled by evaporation which occurs continuously due to air circulation within the secondary compartment.

We claim:

1. A fluid circulating pump adapted for use in an internal combustion engine and including a housing having a fluid chamber and a cavity, a shaft rotatably mounted within the housing and extending through the cavity and terminating in the in the fluid chamber, and a seal assembly in surrounding relation to the shaft to substantially isolate the fluid chamber from the cavity, comprising:

the cavity having an open end communicating with the atmosphere;

a plug having a bore therethrough and being slidably disposed within and in contacting relationship with the housing at the open end, the plug having a cylindrical head portion and an elongated portion extending from the head portion and terminating within the cavity; and connecting means attached to the plug for sealingly engaging the plug with the open end so that the plug is held within the housing and fluid is restricted from escaping into the atmosphere.

2. The fluid circulating pump of claim 1, wherein the plug includes a threaded portion extending from the head portion opposite the elongated portion and terminating within the atmosphere.

3. The fluid circulating pump of claim 2, wherein the connecting means has a cylindrical crown portion with a top surface, bottom surface, and a cylindrical inner wall extending downwardly from the top surface toward the bottom surface and terminating at a shoulder.

4. The fluid circulating pump of claim 3, wherein the plug includes a non-metallic grommet partially disposed within the cylindrical inner wall between the head portion and the connecting means and being in surrounding relation to the threaded portion, the non-metallic grommet being in contacting relationship with the shoulder of the connecting means.

5. The fluid circulating pump of claim 4, wherein the connecting means has an internally threaded bore threaded onto the threaded portion of the plug so that the non-metallic grommet is placed in compression inducing radial expansion.

* * * * *